US006693396B1

(12) United States Patent
Hsu

(10) Patent No.: US 6,693,396 B1
(45) Date of Patent: Feb. 17, 2004

(54) APPARATUS FOR DRIVING A DISCHARGE LAMP

(75) Inventor: Yung-Yi Hsu, Taipei (TW)

(73) Assignee: Benq Corporation

( * ) Notice: Subject to any disclaimer, the term of this patent is extended or adjusted under 35 U.S.C. 154(b) by 0 days.

(21) Appl. No.: 10/208,340

(22) Filed: Jul. 29, 2002

(51) Int. Cl.[7] ..... H05B 41/36
(52) U.S. Cl. ..... 315/291; 315/307
(58) Field of Search ..... 315/291, 219, 315/224, 225, 239, 244, 293, 307, 308, 362, DIG. 4, DIG. 5, DIG. 7; 363/123, 131, 133

(56) References Cited

U.S. PATENT DOCUMENTS 4,277,728 A * 7/1981 Stevens ..... 315/307
4,319,164 A * 3/1982 Tulleners ..... 315/219
5,051,660 A * 9/1991 Domann et al. ..... 315/219
5,408,162 A * 4/1995 Williams ..... 315/224
6,198,236 B1 * 3/2001 O'Neill ..... 315/307

FOREIGN PATENT DOCUMENTS

JP 403293320 A * 12/1991

* cited by examiner

*Primary Examiner*—Don Wong
*Assistant Examiner*—Thuy Vinh Tran
(74) *Attorney, Agent, or Firm*—Ladas & Parry

(57) ABSTRACT

The inventive apparatus includes a switching regulator, a DC-to-AC inverter, and level shifter circuitry. The switching regulator, having a switch, is used to regulate an average magnitude of a low voltage DC signal. The DC-to-AC inverter steps up the low voltage DC signal to a high voltage AC signal applied to the discharge lamp. The inventive apparatus further includes a brightness controller having a brightness table of the relationship between a duty cycle of a dimming control signal and the lamp's current. The level shifter circuitry is coupled between the brightness controller's output and a control terminal of the switch for translating the dimming control signal to a voltage level required for turning on the switch.

12 Claims, 3 Drawing Sheets

APPARATUS FOR DRIVING A DISCHARGE LAMP

FIELD OF THE INVENTION

The present invention relates generally to circuitry for driving discharge lamps and, in particular, to a liquid crystal display (LCD) backlight inverter.

BACKGROUND OF THE INVENTION

There has been an ever-increasing demand for LCD displays within the past few years. Such displays are being employed by all types of computer devices including flat display monitors, personal wireless devices and organizers, and large public display boards. Typically, LCD panels utilize a backlighting arrangement which includes a discharge lamp that provides light to the displayed images. Among those currently available discharge lamps, cold cathode fluorescent lamps (CCFLs) provide the highest efficiency for backlighting the display. These CCFLs require high voltage AC to operate, mandating a highest efficient DC to AC inverter.

FIG. 1 illustrates a simplified schematic diagram of a conventional LCD backlight inverter 100. As shown in FIG. 1, a well-known Royer circuit 110 is employed to convert a relative low direct current (DC) input voltage into a higher alternating current (AC) output voltage for driving a CCFL 102. The Royer circuit 110 includes a pair of transistors Q11 and Q12, a step-up transformer T1, and a resonant capacitor C11. The capacitor C11 is connected across a primary winding $W_P$ of the transformer T1. A secondary winding $W_S$ of the transformer T1 is coupled to a ballast capacitor C12 in series with the lamp 102. The transistors Q11 and Q12 are switched on and off alternately by the base drive provided by a feedback winding $W_F$ of the transformer T1. In addition, the primary winding $W_P$ is provided with a center tap coupled to a buck inductor L1. A DC input source $V_{DC}$ is applied to a transistor-type switch Q13. The inductor L1 coupled between the switch Q13 and the primary winding's center tap converts input DC voltage to a DC current. A diode D11 connected between the output of the switch Q13 and ground places fixed limit on the voltage excursion across the inductor L1.

Still referring to FIG. 1, the backlight inverter 100 also includes a PWM circuit 120 for dimming control of the lamp 102. Since a lamp's intensity (lumen) is a direct function of the lamp current, the LCD backlight can be dim-controlled by regulating the lamp current flowing through the CCFL 102. Typically, the lamp current is sensed with a resistor R1 in series with one lead of the lamp 102 and regulated by varying the average voltage impressed across the inductor L1. The PWM circuit 120 detects a sensing signal from a feedback network formed by the resistor R1 and a diode D12, and it also receives a brightness control signal BR with variable DC levels so as to provide a pulse width modulation (PWM) signal to the switch Q13. A LCD panel controller (not shown) generally produces the signal BR with a DC level indicative of the desired amount of current through the lamp. As a result, the PWM circuit 120 changes the duty cycle of its PWM output signal applied to the switch Q13 in response to the feedback sensing signal and the brightness control signal BR. This allows the transistor switch Q13 to vary the average voltage impressed across the buck inductor L1, thereby adjusting the lamp's current and dimming the CCFL 102.

However, a drawback of the conventional inverter 100 is that dimming control is acquired at the expense of the PWM circuit 120 and the added feedback network, and consequently at higher component count and cost. Especially, the PWM circuit 120 makes up most of the cost of production of the LCD backlight inverter. Therefore, what is needed is an apparatus for dimming control of LCD backlight without the use of PWM circuitry.

SUMMARY OF THE INVENTION

It is an object of the present invention to provide an apparatus for driving a discharge lamp that is less costly and includes fewer parts than conventional design.

It is another object of the present invention to provide an apparatus for dimming control of LCD backlight without the use of PWM circuitry.

The present invention is generally directed to an apparatus for driving a discharge lamp. According to one aspect of the invention, the apparatus includes a switching regulator, a DC-to-AC inverter, and level shifter circuitry. The switching regulator receives a DC voltage source and produces a low voltage DC signal, and has a switch configured to turn on and off periodically in response to a duty cycle of a dimming control signal to chop up the DC voltage source output. The switching regulator is therefore used to regulate an average magnitude of the low voltage DC signal. The level shifter circuitry is provided for translating the dimming control signal to a voltage level required for turning on the switch. The DC-to-AC inverter is configured to step up the low voltage DC signal to a high voltage AC signal applied to the discharge lamp, in which the high voltage AC signal provides a lamp current flowing through the discharge lamp. Note that the duty cycle of the dimming control signal is varied according to a brightness table of the relationship between the duty cycle and the lamp current. Further, the inventive apparatus includes a brightness controller having the brightness table of the relationship between the duty cycle of the dimming control signal and the lamp current. The brightness controller generates the dimming control signal and varies the duty cycle of the dimming control signal based on the corresponding lamp current in the brightness table.

According to another aspect of the invention, an apparatus for dimming control of a discharge lamp is disclosed. The inventive apparatus includes a switching regulator receiving a DC voltage source and producing a low voltage DC signal. The switching regulator has a power switch configured to turn on and off periodically in response to a duty cycle of a dimming control signal to chop up the DC voltage source output, and it is used to regulate an average magnitude of the low voltage DC signal. A DC-to-AC inverter is provided for stepping up the low voltage DC signal to a high voltage AC signal applied to a discharge lamp, in which the high voltage AC signal provides a lamp current flowing through the discharge lamp. The inventive apparatus also includes a brightness controller having a brightness table of the relationship between the duty cycle of the dimming control signal and the lamp current. The brightness controller generates the dimming control signal as output and varies the duty cycle of the dimming control signal based on the corresponding lamp current in the brightness table. Moreover, level shifter circuitry coupled between an output terminal of the brightness controller and a control terminal of the power switch is used to translate the dimming control signal to a voltage level required for turning on the power switch.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF THE INVENTION

Figure 1:
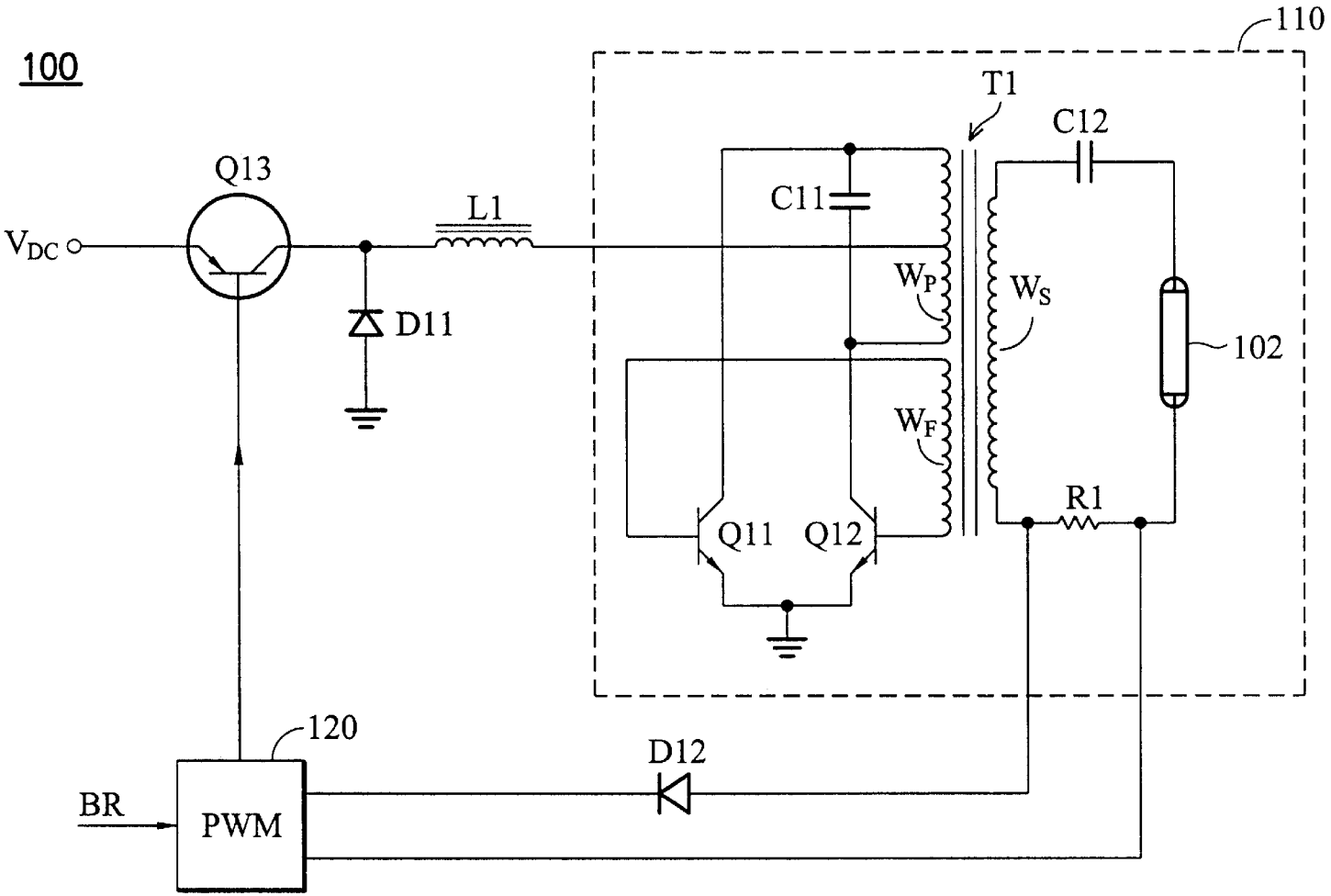
FIG. 1 (PRIOR ART)
FIG. 1 is a schematic diagram illustrating a LCD backlight inverter according to the prior art.
Figure 2A:
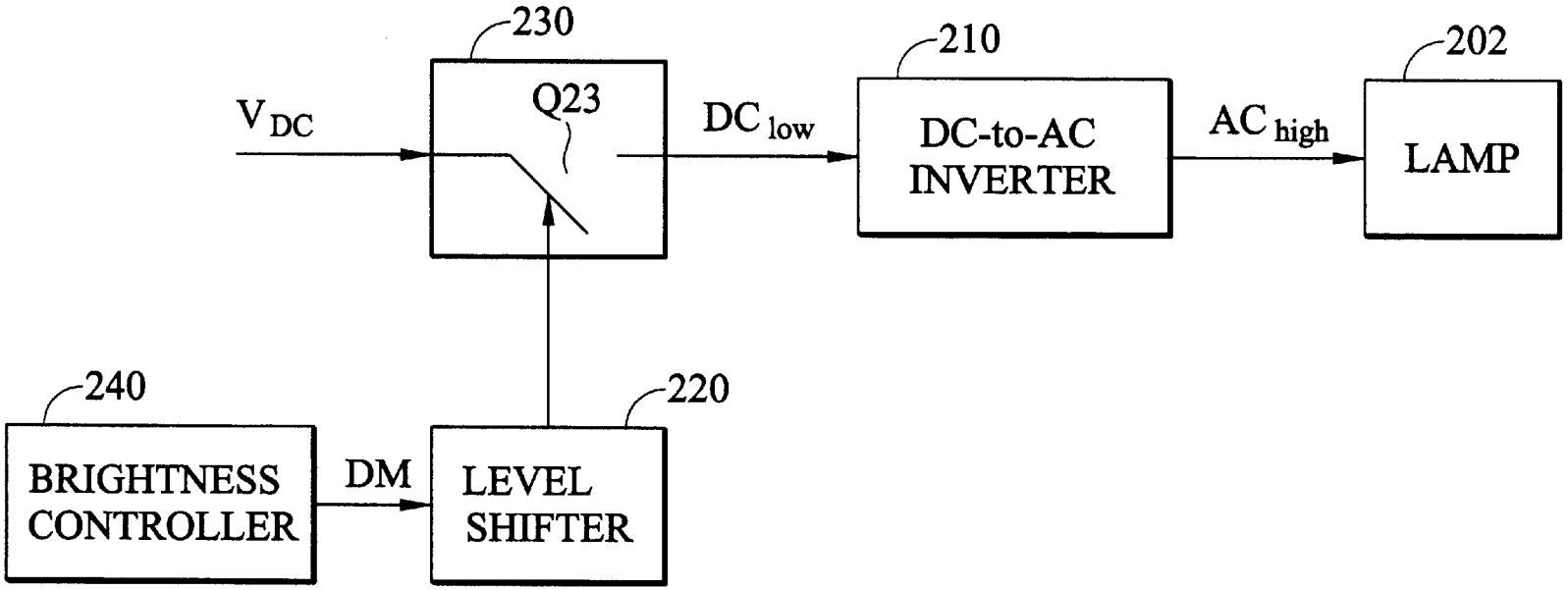
FIG. 2A is a block diagram illustrating a LCD backlight inverter according to the invention.

FIG. 2A illustrates a block diagram of a LCD backlight inverter in accordance with the invention. As depicted, a switching regulator 230 receives a DC voltage source $V_{DC}$ and produces a low voltage DC signal $DC_{low}$. The switching regulator 230 includes a switch Q23 configured to turn on and off periodically, such that the switching regulator 230 can regulate an average magnitude of the low voltage DC signal in response to a duty cycle of a dimming control signal DM by chopping up the DC voltage source output. Level shifter circuitry 220 coupled between a LCD panel controller 240 and the switch Q23 is used to translate the dimming control signal DM to a voltage level required to turn on the switch Q23. A DC-to-AC inverter 210 is configured to step up the low voltage DC signal $DC_{low}$ to a high voltage AC signal $AC_{high}$. Thus, the high voltage AC signal $AC_{high}$ is applied to the lamp 202 so as to provide a lamp current through the discharge lamp 202. In particular, the LCD panel controller 240 has a brightness table of the relationship between the duty cycle of the dimming control signal DM and the lamp current, which in effect serves as a brightness controller. The brightness controller 240 generates the dimming control signal DM as output and varies the duty cycle of the dimming control signal based on the corresponding lamp current in the brightness table.

Figure 2B:
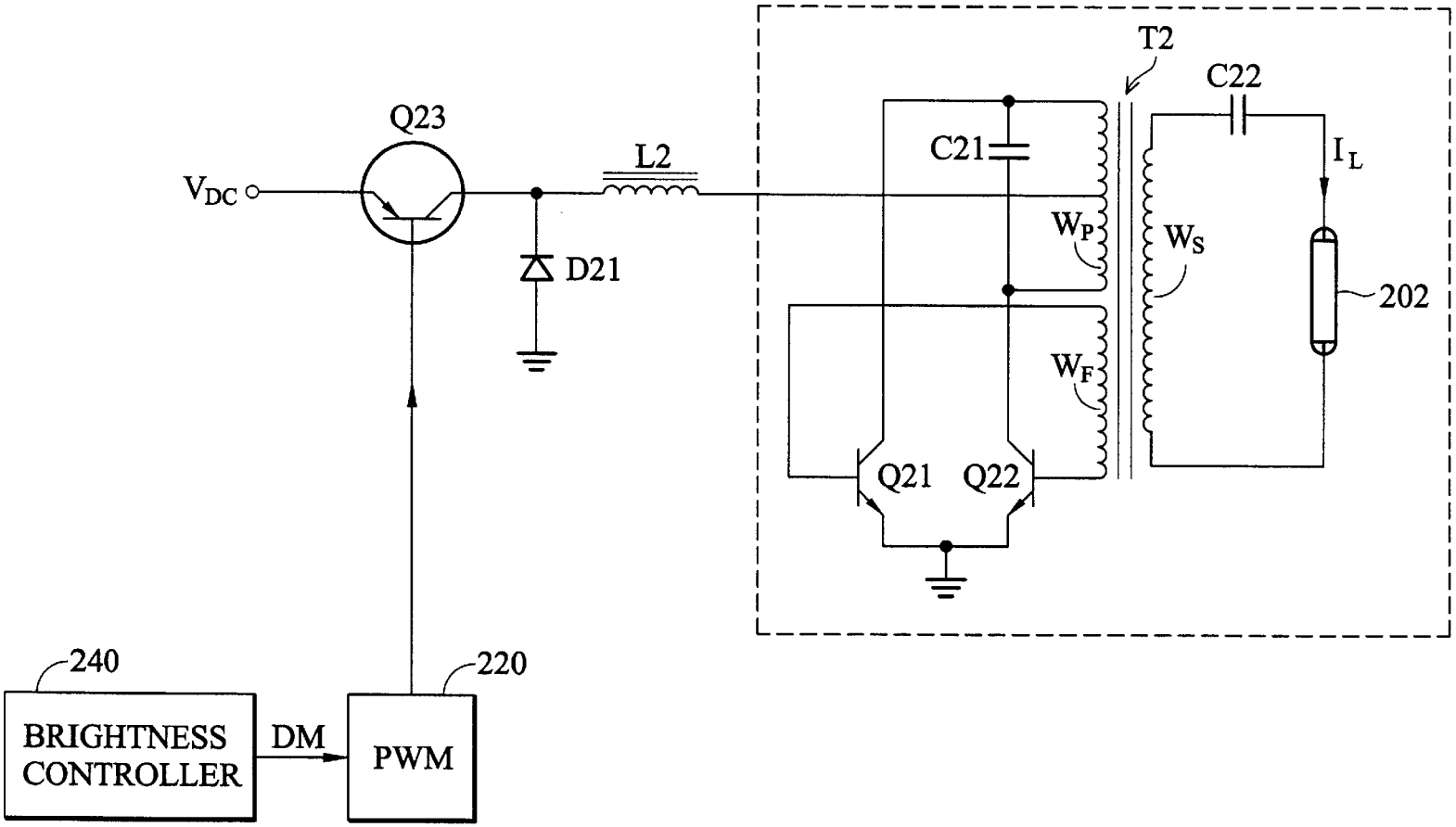
FIG. 2B is a schematic diagram illustrating a LCD backlight inverter according to the invention.

The invention will be explained from a simplified schematic diagram of FIG. 2B. In one embodiment, the switching regulator 230 is a buck regulator, and the DC-to-AC inverter 210 is a resonant push-pull converter. The switch Q23 is representative of a transistor-type power switch. The DC-to-AC inverter 210 is constructed of a step-up transformer T2, a pair of transistors Q21 and Q22, and a capacitor C21. The capacitor C21 is connected across a primary winding $W_P$ of the transformer T2. A secondary winding $W_S$ of the transformer T2 is coupled to a capacitor C22 in series with the lamp 202. The lamp 202 is representative of a CCFL, and the capacitor C22 is used as an output ballast setting the lamp current $I_L$. In addition, the primary winding $W_P$ is provided with a center tap coupled to an inductor L2. The DC voltage source $V_{DC}$ is applied to the power switch Q23. The inductor L2 coupled between the power switch Q23 and the primary winding's center tap is employed as a current source. Due to the presence of the L2, the inverter 210 is essentially a current-fed resonant push-pull converter. A diode D21 connected between the output of the power switch Q23 and ground functions as a clipping diode.

If the inverter of the invention is used in battery-powered systems, the DC voltage source is a battery supplying a DC voltage ranging from 7 to 20 Volts with a nominal value of about 12 Volts. The step-up transformer T2 employs its feedback winding $W_F$ to control the transistors Q21 and Q22 switching on and off alternately. The inductor L2 and the capacitor C21 force the DC-to-AC inverter 210 to run sinusoidally, thereby providing the preferred drive waveform to the lamp 202. In addition, voltage step-up is achieved by the $W_S$:($W_P$+$W_F$) turn ratio. Consequently, the signal $DC_{low}$ is stepped up with the transformer T2 to a relatively high voltage, for example, from 12 Volts to a CCFL's strike voltage of approximately 1500 Volts.

In order to achieve dimming, it is necessary to vary the voltage provided by the buck regulator 230. The power switch Q23 connected in series with the DC voltage source can be turned on and off under control of the signal DM, and thus blocking the flow of energy. The voltage at the input to the inductor L2 is chopped by the power switch Q23, which regulates the average input to the DC-to-AC inverter 210 and thus controls the magnitude of the lamp current $I_L$. The brightness controller 240 generates the dimming control signal DM which is substantially a succession of pulses with adjustable duty cycle. However, it is required that the level shifter circuitry 220 couples between an output terminal of the brightness controller 240 and a control terminal of the power switch Q23. The level shifter circuitry 220 translates the dimming control signal DM from the logic level used in the brightness controller 240 to a voltage required for turning on the power switch Q23.

The above-described brightness table can be obtained by experiment and tested for various backlight arrangements. As implemented in accordance with one embodiment of the invention, the brightness table of the relationship between the duty cycle of the dimming control signal DM and the lamp current $I_L$ is given in Table 1 below. It is appreciated to those skilled in the art that Table 1 merely shows 6 brightness settings for brevity.

TABLE 1

| Duty Cycle | Lamp Current |
|---|---|
| 56.8% | 12.4 mA (MAX.) |
| 51.6% | 11.2 mA |
| 49.7% | 9.94 mA |
| 48.6% | 8.70 mA |
| 46.4% | 7.40 mA |
| 45.0% | 6.05 mA (MIN.) |

Note that table 1 is obtained if two discharge lamps are dimmed. Since a lamp's intensity is a direct function of the lamp current, the lamp 202 can be dim-controlled by regulating the lamp current $I_L$. The brightness controller 240 varies the duty cycle of the dimming control signal DM based on the brightness table, thus providing the desired amount of current through the lamp 202. For example, if the brightness controller 240 outputs the dimming control signal DM with a 56.8% duty cycle, the inverter of the invention generates the maximum lamp current and thus the CCFL 202 illuminates at full brightness.

Accordingly, it is possible to achieve variable dimming without the use of PWM circuitry and feedback network. The LCD backlight inverter of the invention compacts the prior art into a low component count and decreases the cost. Practically, the invention can reduce 42.1% of the components and achieve a saving of 25.7% on cost.

While the invention has been described by way of example and in terms of the preferred embodiment, it is to be understood that the invention is not limited to the disclosed embodiment. To the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. An apparatus for driving a discharge lamp comprising:

a switching regulator receiving a DC voltage source and producing a low voltage DC signal, having a switch configured to turn on and off periodically in response to a duty cycle of a dimming control signal to chop up the DC voltage source output, for regulating an average magnitude of the low voltage DC signal;

level shifter circuitry for translating the dimming control signal to a voltage level required for turning on the switch; and a DC-to-AC inverter configured to step up the low voltage DC signal to a high voltage AC signal applied to the discharge lamp, in which the high voltage AC signal provides a lamp current flowing through the discharge lamp;

wherein the duty cycle of the dimming control signal is varied according to a brightness table of the relationship between the duty cycle and the lamp current.

2. The apparatus as recited in claim 1, further comprising a brightness controller having the brightness table of the relationship between the duty cycle of the dimming control signal and the lamp current, for generating the dimming control signal and varying the duty cycle of the dimming control signal based on the corresponding lamp current in the brightness table.

3. The apparatus as recited in claim 2 wherein the lamp current flowing through the discharge lamp varies directly with the duty cycle of the dimming control signal.

4. The apparatus as recited in claim 1 wherein the switch in the switching regulator is a transistor-type switch.

5. The apparatus as recited in claim 1 wherein the switching regulator is a buck regulator.

6. The apparatus as recited in claim 1 wherein the DC-to-AC inverter is a resonant push-pull converter.

7. An apparatus for dimming control of a discharge lamp comprising:

a switching regulator receiving a DC voltage source and producing a low voltage DC signal, having a power switch configured to turn on and off periodically in response to a duty cycle of a dimming control signal to chop up the DC voltage source output, for regulating an average magnitude of the low voltage DC signal;

a DC-to-AC inverter configured to step up the low voltage DC signal to a high voltage AC signal applied to the discharge lamp, in which the high voltage AC signal provides a lamp current flowing through the discharge lamp;

a brightness controller, having a brightness table of the relationship between the duty cycle of the dimming control signal and the lamp current, for generating the dimming control signal as output and varying the duty cycle of the dimming control signal based on the corresponding lamp current in the brightness table; and level shifter circuitry coupled between an output terminal of the brightness controller and a control terminal of the power switch, for translating the dimming control signal to a voltage level required for turning on the power switch.

8. The apparatus as recited in claim 7 wherein the lamp current flowing through the discharge lamp varies directly with the duty cycle of the dimming control signal.

9. The apparatus as recited in claim 7 wherein the power switch in the switching regulator is a transistor-type switch.

10. The apparatus as recited in claim 7 wherein the switching regulator is a buck regulator.

11. The apparatus as recited in claim 7 wherein the DC-to-AC inverter is a resonant push-pull converter.

12. The apparatus as recited in claim 7 wherein the duty cycle of the dimming control signal ranges from 45.0% to 56.8% in the brightness table if two discharge lamps are dimmed.

* * * * *